US007146692B2

(12) United States Patent
Benedict

(10) Patent No.: US 7,146,692 B2
(45) Date of Patent: Dec. 12, 2006

(54) NON-INERTIAL RELEASE SAFETY RESTRAINT BELT BUCKLE SYSTEMS

(76) Inventor: Charles E. Benedict, 3207 Remington Run, Tallahassee, FL (US) 32312

( * ) Notice: Subject to any disclaimer, the term of this patent is extended or adjusted under 35 U.S.C. 154(b) by 0 days.

(21) Appl. No.: 10/669,381

(22) Filed: Sep. 25, 2003

(65) Prior Publication Data

US 2004/0255438 A1 Dec. 23, 2004

Related U.S. Application Data

(63) Continuation-in-part of application No. 10/462,738, filed on Jun. 17, 2003, now abandoned.

(51) Int. Cl.
*A44B 21/00* (2006.01)
*A44B 11/26* (2006.01)

(52) U.S. Cl. ..... 24/635; 24/639; 24/657

(58) Field of Classification Search ..... 24/640, 24/642, 647, 648, 650, 616, 635, 657, 662, 24/664, 593.1, 633, 634, 639
See application file for complete search history.

(56) References Cited

U.S. PATENT DOCUMENTS 1,384,001 A * 7/1921 Splittstoesser ..... 24/645
2,153,077 A * 4/1939 Clarke ..... 24/645
2,941,272 A * 6/1960 Bourguignon ..... 24/657
3,605,210 A * 9/1971 Lohr ..... 24/642
4,334,341 A * 6/1982 Krautz et al. ..... 24/635
4,675,956 A * 6/1987 Cohen ..... 24/642
4,809,409 A * 3/1989 Van Riesen ..... 24/635
5,355,562 A * 10/1994 Matoba et al. ..... 24/625
5,359,756 A * 11/1994 Miyauchi et al. ..... 24/640

* cited by examiner

*Primary Examiner*—Jack W. Lavinder
(74) *Attorney, Agent, or Firm*—Dowell & Dowell, P.C.

(57) ABSTRACT

Body restraint systems for vehicles that include buckles for latching and retaining latch plates associated with safety belts. The buckle of each system includes a pair of oppositely biased latching mechanisms that are operative in such a manner that a force applied to release one latching mechanism from a latch plate inserted within the buckle creates an opposite and equal force against the opposite latching mechanism to thereby positively retain the latch plate within the buckle in a locked position. Release of a latch plate can only occur upon the simultaneous movement of both of the oppositely biased latching mechanisms toward one another by application of manual force and thus release of the latch plate cannot occur by inertial forces that may be encountered in a vehicular accident.

14 Claims, 8 Drawing Sheets

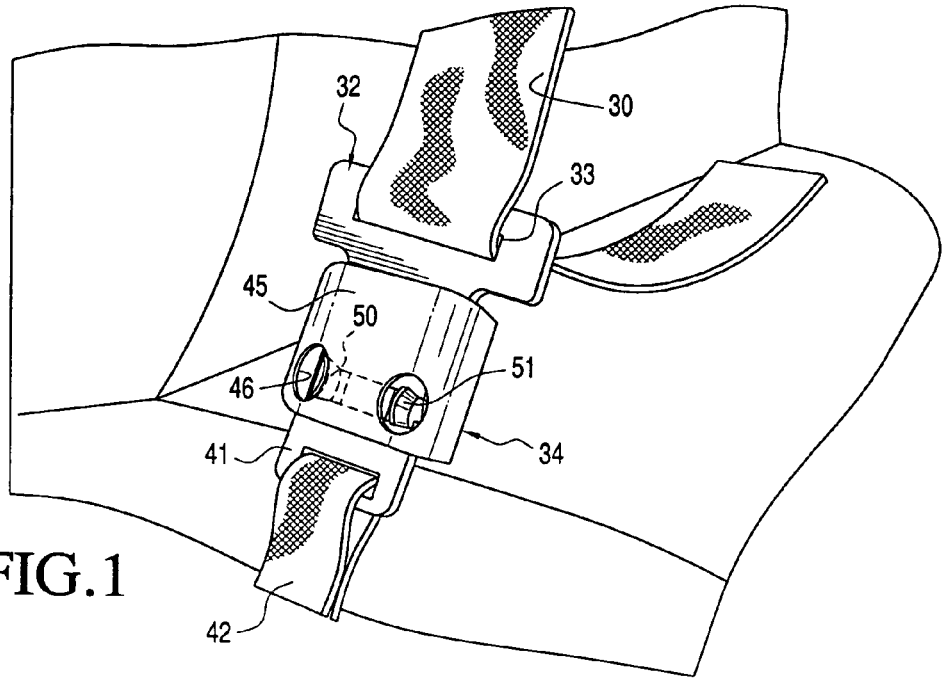
FIG.1
FIG.2
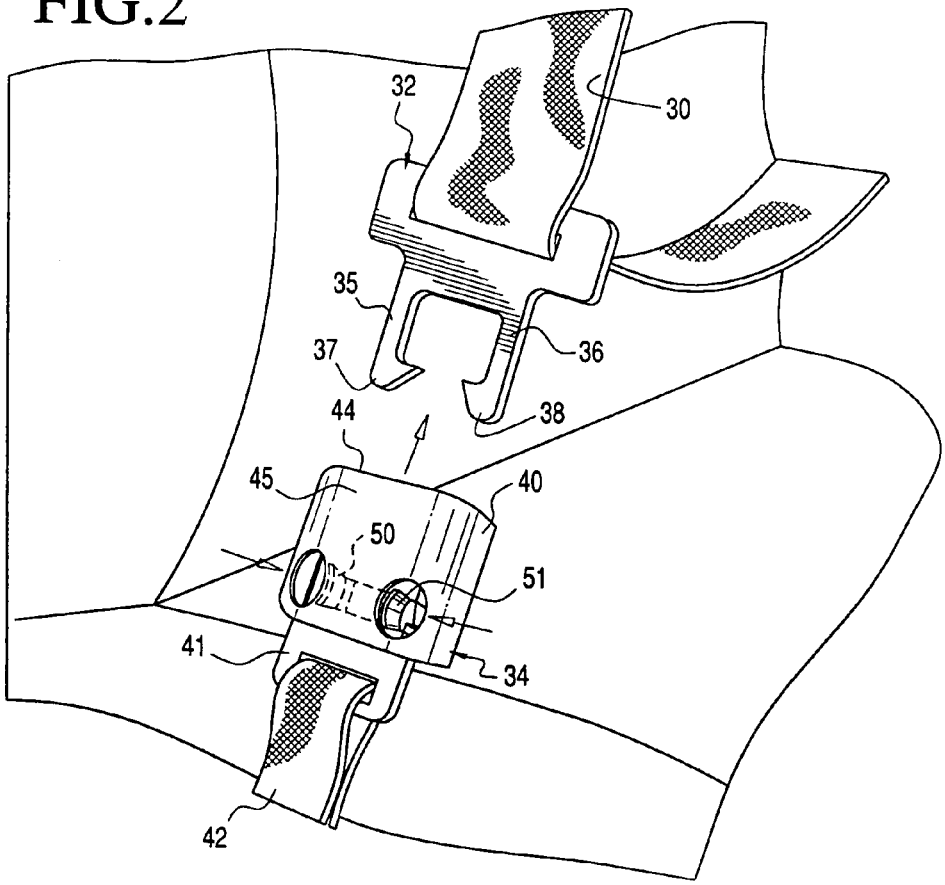

FIG.10
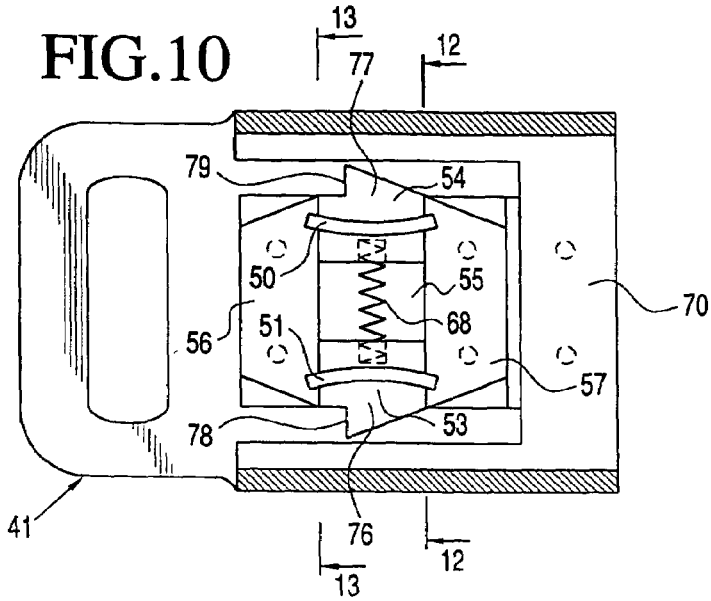
FIG.11
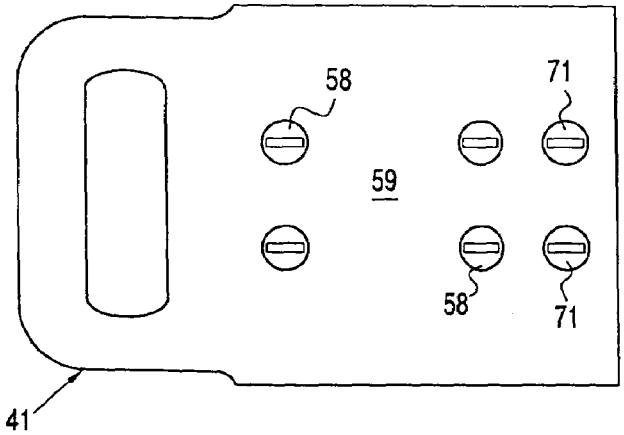
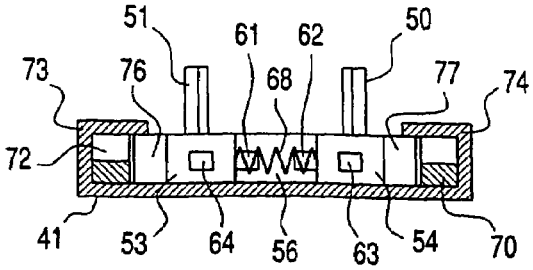
FIG.12
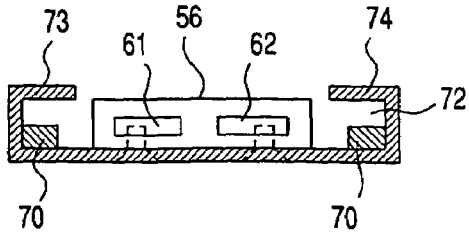
FIG.13

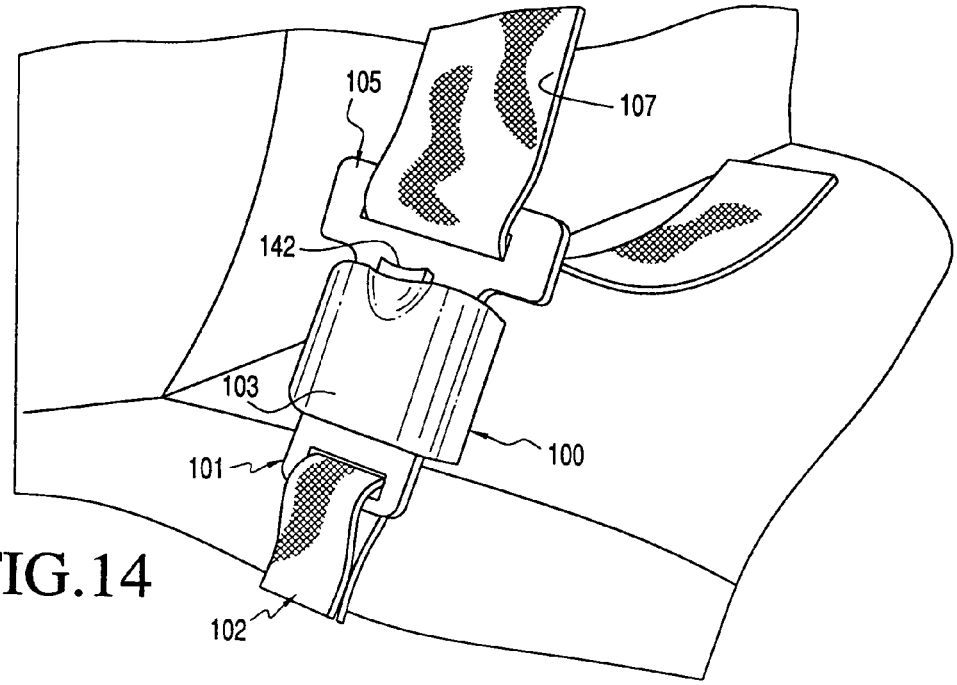
FIG.14
FIG.15
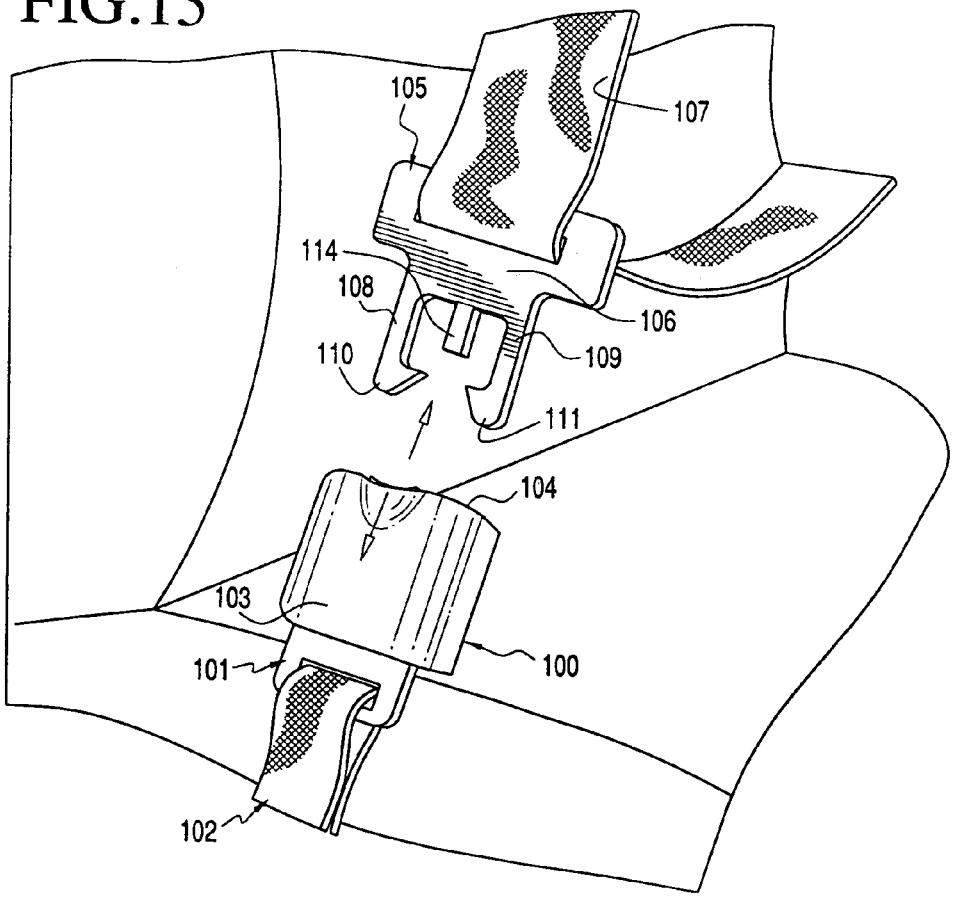

FIG.23
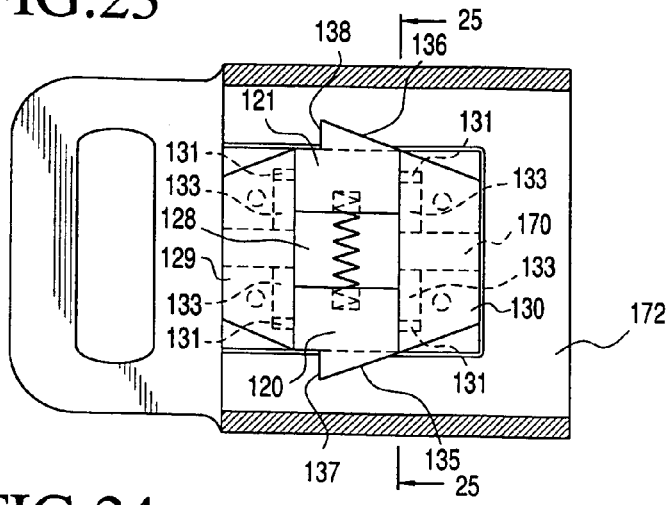
FIG.24
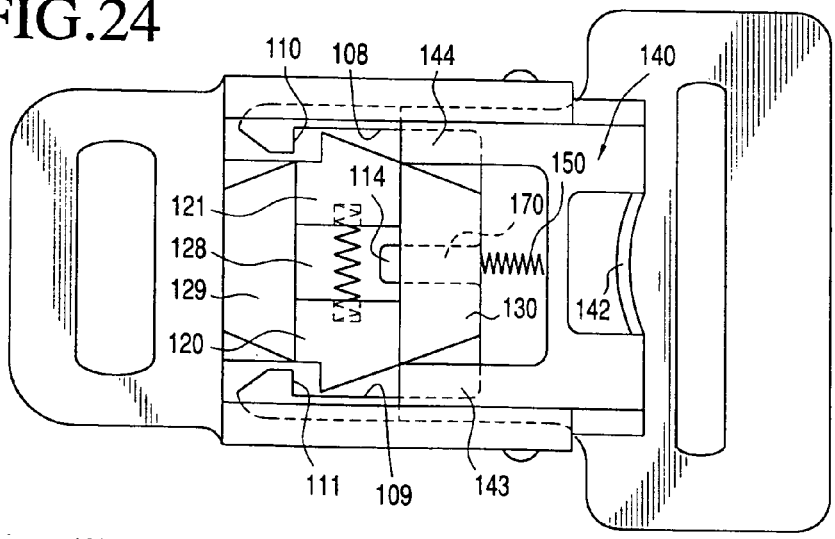
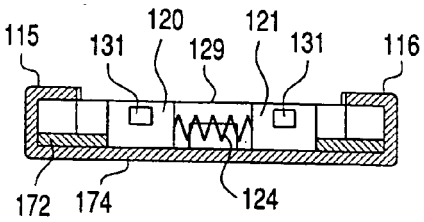
FIG.25
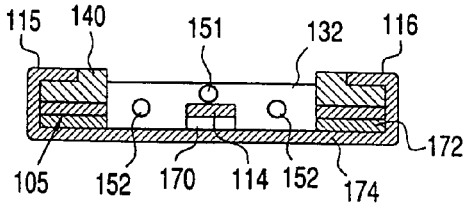
FIG.26
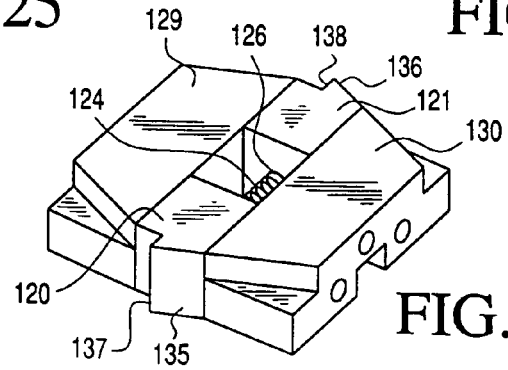
FIG.27

NON-INERTIAL RELEASE SAFETY RESTRAINT BELT BUCKLE SYSTEMS

CROSS REFERENCE TO RELATED APPLICATION

This application is a continuation-in-part application of application Ser. No. 10/462,738 filed Jun. 17, 2003 now abandoned entitled NON-INERTIAL SAFETY RESTRAINT BELT BUCKLE SYSTEMS in the name of the same inventor.

BACKGROUND OF THE INVENTION

1. Field of the Invention

This invention is generally directed to vehicle safety restraint systems including shoulder and lap seat belts and more particularly to such restraint systems that include a buckle that houses oppositely biased locking or latching mechanisms that are operable to resiliently engage locking tongs of a latch plate as a latch plate is inserted within the buckle. The latching mechanisms prevent release of the latch plate due to inertial forces created during a vehicle accident, such as a vehicle roll-over. The latch plate can only be released by manual operating one or more release buttons which cause the simultaneous movement of the latching mechanism in opposite directions relative to one another to positions wherein the locking tongs of the latch plate are no longer engaged.

2. Description of Related Art

Body restraint systems including seat belts, lap belts, shoulder harnesses and the like have been credited with saving numerous lives which otherwise would have been lost in vehicular accidents. The positive benefits obtained due to body restraints systems has been so recognized that, in the United States, the use of seat belts is mandated in all states.

Since their inception, there have been numerous innovative advances made to improve upon the safety and reliability of vehicle body restraint systems. Improvements have been made to the belt and belt materials, the manner in which the belt restraint systems are mounted within vehicles, the manner in which such restraint systems may be automatically adjusted to provide proper tension to suit not only safety standards but to also provide for a measure of passenger comfort and further to improve upon the security of the locking devices and belt buckles associated with such systems.

Most conventional vehicle body restraint systems incorporate a belt which either crosses in front of the lap or diagonally across the body of the vehicle operator or passenger in such a manner as to not adversely interfere with a region of an individual's neck. Belts are retained by latching assemblies including belt buckles into which latch plates carried by the belts can be inserted so as to automatically become locked to the buckles which are normally anchored relative to vehicle frames.

Conventional systems generally utilize two types of release mechanisms for allowing latch plates to be removed from buckle housings such that drivers and passengers can disembark vehicles. A first or side release system includes an operating release button which is generally resiliently urged outwardly at an angle which is perpendicular to an axis or line of insertion of the latch plate into a buckle housing. A second type of conventional release system is known as an end release system and includes an operating lever or button for releasing the latch plate from the buckle housing and which lever is mounted at an end of the buckle housing.

Currently, virtually all types of latching mechanisms for body restraint systems in automotive vehicles are subject to premature release when subjected to at least one mode of inertial force which can be created under various conditions resulting from collisions, rollovers and other types of loss of vehicle control. Side release latching assemblies or mechanisms, referred to as Type 1 and Type 6 in the industry, will inertially release when subjected to lateral forces which are applied to a backside of a buckle during a vehicle collision or rollover. Such latching assemblies will also release by the release buttons being forceably engaged by an object in a vehicle accidently depressing the buttons during an accident, collision or rollover, thereby prematurely destroying the effectiveness of the restraint systems which can cause severe or deadly injury to persons using the systems.

By way of example, if a person's hip strikes the backside of a buckle frame during an accident, the interior latch which engages a latch plate of a seat belt can and will release when the striking force level is sufficient to cause the inertia of the latch mass, relative to the acceleration and displacement of the buckle frame, to compress a leaf spring and unlatch the buckle.

End type release latching systems will inertially release due to the mass of the release buttons associated therewith when taken into consideration the mass of movement of the latch plate and the direction of rotational release of the latch plate when subjected to an upward or upward and lateral force opposite the locking direction of a latch dog associated with such a mechanism, especially during vehicle rollovers. This upward or upward and lateral mode of failure occurs when an occupant is more apt to be ejected from a vehicle and thus can result in severe bodily injury or death.

An example of end release latching system for seat belts is disclosed in U.S. Pat. No. 4,358,879 to Magyar. The system uses a release button which is pushed down to release the latch plate as opposed to being pushed laterally as in the side release systems.

Virtually all end release buckles, generally referred to as Type II buckles, operate using an over-the-center mechanism so the actual latch uses either a fairly weak compression spring or a leaf spring for a latching force. A so called "lock for the latch" is a rod or bar that follows an "L" shaped track where the lock bar moves laterally across the buckle frame in a direction of latch movement and then moves vertically along a leg of the "L" and behind the latch after the latch goes over-the-center to its latched position. This movement supposedly locks the latch from moving laterally from lateral forces acting on the buckle frame that would inertially move the latch laterally relative to the buckle frame.

However, the end release buckles have a release button, release slider, lock bar (pin) latch and two compression springs, all of which have mass. One spring actuates the latch laterally and the other spring acts against the latch plate to keep a locking edge in contact with the latch surface or "dog" and applies an upward force against the release button. This spring also acts to eject the latch plate from the buckle when the latch button is depressed and the latch is disengaged.

When vertical forces, or forces with enough vertical component on a buckle, such as forces created by impacts to a bottom of a vehicle in a rollover, are sufficiently high enough, the buckle latch will release. The design of these buckles is such that it requires both a vertical (longitudinal) and horizontal (lateral) component in many cases because the vertically upward forces causes an equally vertical downward inertial force to the release button and related component, which causes them to move in a downward (release) direction due to their mass and acceleration relative to the buckle frame. When the components of the release mechanism approach an elbow of the locking "L" slot, the locking pin or bar follows the path of the slot and releases the latch and the compression spring against which these inertia forces are acting, and ejects the latch plate.

The forces acting on a latch plate/buckle assembly that create inertia forces in a release direction come from various and foreseeable sources and directions and always follow Newton's Law. Some of these are:

a) vertical to horizontal forces acting on a vehicle and thus a buckle assembly from impact to the ground during vehicle rollovers;

b) vertical to horizontal forces acting on a vehicle and thus on a buckle assembly from impact to the vehicle from another vehicle, fixed object or other movable object within a path of the vehicle;

c) vertical to horizontal forces acting on a buckle assembly by objects within the vehicle, such as occupants or loose objects;

d) vertical to horizontal forces acting on a buckle assembly from it being driven into objects within the vehicle, such as a center console between a driver and a passenger or between vehicle occupants; and e) vertical to horizontal forces acting on a latch plate and release mechanism mass from impulses resulting from emergency management loop release as well as harness mounted air bags and the like where tension on a harness/lap belt webbing is suddenly tightened or released causing a large, near longitudinal impulse force into the buckle, latch plate and release mechanism mass sufficient to cause an acceleration of the mass of the release mechanism parts to develop an inertia force exceeding a release mechanism spring force acting against a release mechanism mass.

A latch plate weighs anywhere from approximately two (2) to five (5) ounces, depending on whether it is a slip, partial slip or slip lock latch plate. A weight (mass) of the release components of the buckle (button, slider, locking pin, etc.) is a fraction of the latch plate weight.

The dynamic problem with the end release buckles is that when there is an upward force or upward component of force acting on the buckle or a downward impulse from sudden tensile loading/unloading of seat belt webbing through the latch plate, the latch plate mass applies a downward inertia force or impulse that drives an unlatch mechanism downward toward an unlatch position, accelerating the unlatch mechanism masses downward and thus causing the latch to release. Any horizontal or lateral force acting on the buckle frame in an opposite direction to the unlatch direction compounds the unlatching due to acceleration forces acting on the buckle frame.

The above modes of failure are inherent in virtually all conventional side and end release latching mechanisms of conventional vehicle restraint systems. The side release buckle systems are generally simpler and have fewer moving parts and thus are more economical to construct and to install, whereas the end release systems are more complex having multiple moving parts and are thus more expensive to manufacture.

In view of the foregoing, there remains a need to further improve upon the reliability and effectiveness of vehicle body restraint safety belt systems to ensure that the latching mechanisms associated therewith cannot be accidently released during substantially any type of vehicular movement including vehicle rollovers caused during accidents, collisions or resulting from loss of control of a vehicle, such as by operator error or vehicle equipment failure. There is a further need to provide for improvements in vehicle body restraint systems which permit the latching assemblies to be more reliable and more economical to construct.

In applicants aforementioned application Ser. No. 10/462,738, the contents which are incorporated herein in their entirety herein by reference, a safety belt restraint system is described which prevents the release of a latching or locking mechanism of a safety belt restraint system by inertial forces which may be directed against the latching assembly during a vehicle accident. In accordance with the invention, each buckle includes a first latch mechanism including a latch dog which is engageable within an opening in a latch plate as the latch plate is inserted within a buckle housing. The latching mechanism is positively retained in engagement with the latch plate by two equally resisted and oppositely oriented push button release mechanisms. The release mechanisms are connected by a resilient element such as a spring such that any force tending to push one of the release buttons inwardly of the buckle to effect a release of the latch plate places an equal and opposite force on the opposite release button to sustain it in a locked position thereby preventing release of the latch plate from the buckle. With this structure, equal and opposite forces must be simultaneously applied to each of the release buttons in order to cause a camming of the latch relative to the latching mechanism to thereby permit withdrawal of the latch plate.

SUMMARY OF THE INVENTION

The present invention is directed to body restraint systems especially adapted for automotive and other vehicles that include buckles for latching and retaining latch plates mounted to seat or lap belts of safety harnesses. Two preferred embodiments of the invention are disclosed. In each embodiment, once a latch plate has been inserted within a buckle, the latch plate is engaged by latching mechanisms which are equally positively biased in opposite directions. In this manner, if there is an application of force to either latching mechanism in a direction to move it from a locked position, engaging the latch plate, to an unlocked position, to release the latch plate, an opposite and equal force will be directed to the opposite latching mechanism to retain the opposite latching mechanism in engagement with the latch plate. In both embodiments, release of the latch plates from the buckles is only possible by the simultaneous movement of the oppositely biased latching mechanisms in a direction toward one another. Thus, both latching mechanisms cannot be simultaneously released by the application of inertial forces which may be applied against the buckles.

The safety belt assemblies of each of the restraint systems are each provided with a latch plate having a pair of forwardly extending hooked locking tongs which are receivable within a buckle upon insertion of the latch plate. The tongs are designed to moveably engage the oppositely biased latching mechanisms during latch plate insertion such that lock dogs associated with each latching mechanism engage the hooked ends of the locking tongs to thereby prevent removal of the latch plate.

In each embodiment of the invention, the pair of latching mechanisms are slidable mounted within the buckle and are biased by a resilient element or spring which extends therebetween and which normally urges the latching mechanisms to their outermost or first locking positions wherein they positively engage and retain the locking tongs of the latch plate. Further, each embodiment also includes at least one manually operated release mechanism which is effective to simultaneously urge each of the oppositely biased latching mechanisms toward one another to a second release position wherein the latch dogs associated therewith are withdrawn from engagement with the locking tongs of the latch plate such that the latch plate may be withdrawn from the buckle.

In a first of the embodiments, each of the latching mechanisms is in the form of a slide block which are both mounted within a channel defined between two fixed guide members which are secured within a buckle housing. The buckle housing includes a cover having openings formed in an upper area thereof and generally adjacent each of opposite side edges thereof in which a pair of push button members are engageably oriented. The cover protects accidental movement or engagement of the push buttons by generally extending slightly above each of the push buttons but allows the push buttons to be engaged so that they may be squeezed together by manual manipulation.

The push buttons are secured to the oppositely biased slide blocks of the oppositely biased latching mechanisms so that the latching mechanisms are directly operable in response to the application of force to the push buttons.

With the first embodiment of the invention, there are only three moving components associated with the locking assembly. Each of the two slide blocks of the oppositely oriented latching mechanisms are formed as a single piece having oppositely oriented guide prongs which extend into slots in each of the fixed guide blocks mounted within the buckle housing. In this manner, each of the latching mechanisms is positively guided in reciprocating motion within the channel between the fixed guide blocks. Because the guide blocks are both positively biased by an interconnecting spring, or other resilient element which extends therebetween, an application of force to one of the push buttons to move it from the first locked position to the second release position will result in the application of an equal and oppositely directed force against the other latching mechanism to retain it in its first locked position, thus preventing release of the latch plate from the buckle. Only upon the simultaneous squeezing of the push buttons toward one another can the latch mechanisms be moved simultaneously to their second release positions wherein both are pushed against the force being applied by the intermediate spring. Once both of the latch mechanisms are moved to their second release positions, the latch plate may be easily withdrawn from the buckle housing. Upon release of the push buttons, the resilient element within the buckle will urge the latching mechanisms to their first locked position.

In the second embodiment of the invention, the latching mechanisms are also in the form of slide blocks which are positively guided between a pair of fixed guide blocks which define a channel therebetween in which the latching mechanisms are reciprocally moveable against a spring or other resilient element which extends therebetween so as to apply equal and opposite biasing force against each latching mechanism. Each of the slide blocks of the latching mechanisms also includes a lock dog which is engageable with the hooked tongs of the latch plate when the latch plate is inserted within the buckle housing to thereby retain the latch plate in a locked position. The slide blocks further include a tapered camming surfaces which extend inwardly toward a central longitudinal axis of each buckle housing from the lock dogs toward the opposite end of each slide block. Each slide block is also positively guided by having tabs which extend within slots formed in the opposing guide blocks.

In the second embodiment of the invention, instead of using a pair of manually operable push buttons to create an equal and opposite force to move the latching mechanisms from their first locked position to their second release position, a single longitudinally slidable release button is used. In this embodiment, the release button is integrally formed with and extends upwardly from a rear portion of a slide release member which is preferably formed of a durable plastic material such as a high density polyethylene (HDPE). The body of the slide member is of a size to be guidingly received within a pair of channels formed by an inner frame of the buckle. Guide slots are provided in opposite sidewalls of the slide member in which guide pins extending through the frame of the buckle extend so as to positively retain and guide the slide member in a reciprocating motion within the frame along a direction which is aligned with a longitudinal axis of the buckle. The forward end of the slide member includes two spaced legs which are designed to cooperatively engage the camming surfaces associated with each of the slide blocks. To release the latching mechanisms from engagement with the locking tongs of the latch plate, the push button is manually engaged to urge the slide member inwardly of the buckle housing wherein the legs will engage the camming surfaces of the slide blocks thereby simultaneously urging them toward one another against the spring or other resilient element extending therebetween, thereby moving the latching mechanisms to their second release positions.

The push button is normally urged to a first position wherein the legs associated therewith apply no force on the latching mechanisms. A spring extends from a portion of the slide member intermediate the legs to engagement with one of the guide blocks. Further, in the present embodiment, at least one kick-out spring is mounted within the buckle housing to the one of the fixed guide blocks and is engageable with the latch plate as the latch plate is inserted within the buckle housing. The kick-out springs provide force to automatically eject the latch plate from the buckle housing when the slide member of the manual push button is moved inwardly of the housing to effect a release of the latch plate.

In the second embodiment, the latch plate may also include a tang which extends intermediate the locking tongs. The tang is designed to be selectively receivable within a slot in one of the fixed guide blocks. However, the tang is designed to move through the slot and into the guide channel and between the two latching mechanisms so as to block movement of the latching mechanisms toward one another and thereby prevent the release of the latch plate if inertial forces are applied against the buckle which are sufficient to force the release button toward a release position without conscience application of a sliding manual force. The central tang therefore constitutes a lock for the latching assembly.

It is the primary object of the present invention to provide safety restraint systems for use with lap and shoulder belts associated with vehicles which include buckles having latching mechanisms which can not be released by inertial forces applied to the components thereof such as caused during vehicle accidents, including rollovers.

It is yet another object of the present invention to provide latching and locking mechanisms for seat belt restraint systems which are operative in accordance with Newtonian Laws of Physics to the effect that for every action there is an equal and opposite reaction so that a latch plate of one of the systems can not be released from a buckle unless oppositely directed forces are applied to oppositely biased latching mechanisms associated with each restraint system.

It is also an object of one of the embodiments of the present invention to provide latching and locking mechanisms for seat belt restraint systems wherein an inadvertent or accidental application of force to one of a pair of release push buttons associated therewith cannot cause the premature release of a latch plate and wherein such accidental application of force in effect supplies a greater force to insure that one of the two latching mechanisms associated therewith is retained in a locked position.

It is another of the present invention to provide non-inertial release restraint buckles for use in seat belt restraining systems of the type used in automotive vehicles and the like wherein latching mechanisms associated with each buckle are structured from a minimal number of moving components to thereby reduce the risk of component failure while decreasing manufacturing costs.

BRIEF DESCRIPTION OF THE DRAWINGS

A better understanding of the invention will be had with respect to the two embodiments disclosed and with reference to the attached drawings:

FIG. 1 is a perspective illustrational view of a first embodiment of the invention wherein a latch plate connected to a conventional seat belt is secured within a buckle which is anchored relative to a vehicle by a conventional anchor belt;

FIG. 2 is a view similar to FIG. 1 showing the latch plate being released upon the simultaneous movement of opposing release buttons toward a central longitudinal axis of the buckle;

FIG. 10 is a top cross-sectional view of the embodiment shown in FIG. 3 with the latch plate being removed from the buckle housing;

FIG. 11 is a bottom plan view of the buckle housing of FIG. 10;

FIG. 12 is a cross-sectional view taken along line 12—12 of FIG. 10;

FIG. 13 is a cross-sectional view taken along line 13—13 of FIG. 10;

FIG. 14 is a partial illustrated view of a second embodiment of the invention shown with a seat belt assembly with a latch plate of the seat belt locked within a buckle;

FIG. 15 is a view similar to FIG. 14 with the latch plate released from the buckle by movement of a slide release member;

FIG. 23 is a top cross-sectional view of the embodiment of FIG. 20 with the latch plate and release slide member removed;

FIG. 24 is a top cross-sectional view similar to FIG. 16 showing movement of an intermediate tang of the latch plate to block movement of the latching mechanisms when an inertial force is applied to urge the release slide member to an unlocked position;

FIG. 25 is a cross-sectional view taken along line 25—25 of FIG. 23;

FIG. 26 is a cross-sectional view taken along line 26—26 of FIG. 16; and FIG. 27 is a perspective view of the guide blocks and latching mechanisms of the embodiment shown in FIGS. 14–26.

DESCRIPTION OF THE PREFERRED EMBODIMENTS

Figure 3:
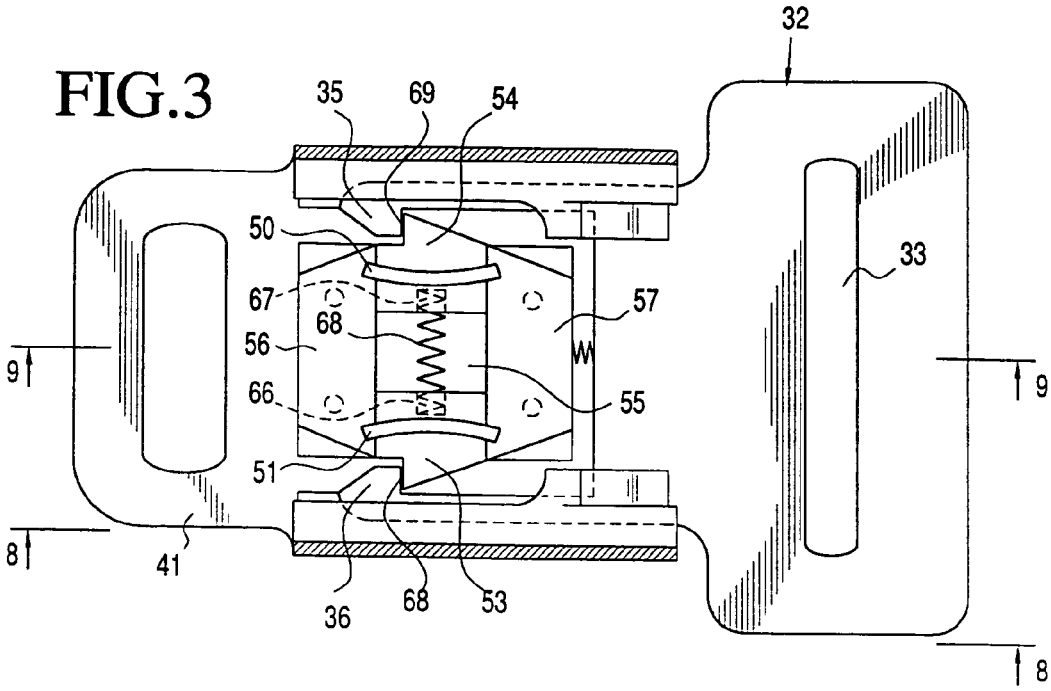
FIG. 3 is a top plan view of the buckle assembly of the first embodiment of the invention shown in FIGS. 1 and 2 wherein the outer housing of the buckle has been removed to show the operative components associated with a latching assembly.

With continued reference to FIGS. 1–13 of the drawings figures, the first embodiment of non-inertial release restraint buckle of the present invention is shown as used with a seat belt restraint system in an automotive vehicle. The restraint system includes a seat belt 30 in the form of a harness and lap belt that is mounted to a latch plate 32 that is specifically designed to be cooperatively used with a buckle 34. The latch plate 32 includes a body portion having an open slot 33 therein through which the belt extends and also includes a pair of forwardly extending locking tongs 35 and 36 which are spaced from one another. Each locking tong includes a hooked portion 37 and 38, respectively, for purposes of cooperating with locking elements of the buckle 34. As shown, the end portion of each of the tongs 35 and 36 is tapered for purposes which will be described in greater detail hereinafter.

The buckle 34 includes an outer housing 40 which substantially covers a metallic frame 41 one end of which is connected to the vehicle by way of an anchoring belt 42. The buckle includes an opening 44 at one end for receiving the latch plate 32. The upper portion 45 of the housing is shown as being slightly convex or dome shape in configuration having a pair of opposing openings 46 and 47 therein adjacent opposite side walls thereof. Extending into the openings but generally not above the upper wall 45 are a pair of manually engageable levers or push buttons 50 and 51. The operation of the push buttons will be described in greater detail with respect to drawing FIGS. 3–13.

Figure 4:
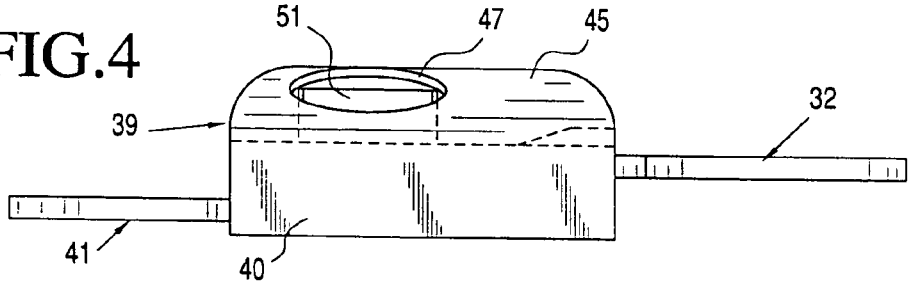
FIG. 4 is a view taken from the right side of the embodiment shown in FIG. 3.
Figure 5:
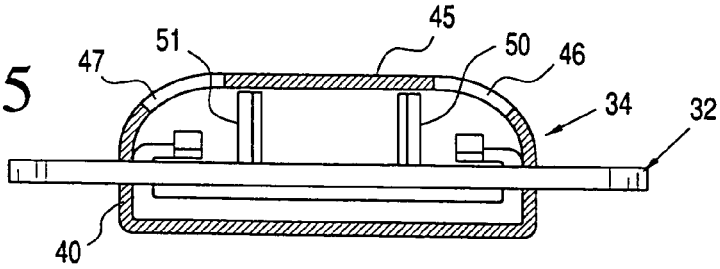
FIG. 5 is a front elevational view of the embodiment shown in FIG. 3.
Figure 6:
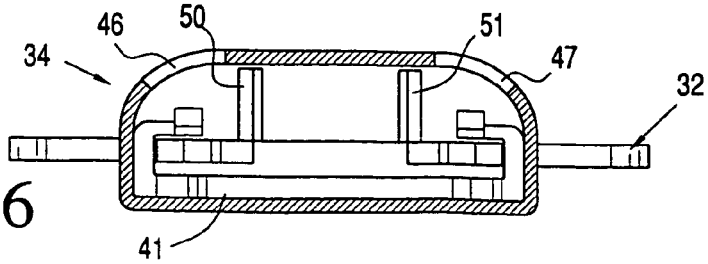
FIG. 6 is a rear elevational view of the embodiment shown in FIG. 3.

With reference to FIGS. 4–6, the configuration of the housing is such as to prevent accidental engagement of the push buttons 50 and 51 during normal use of the seat belt 34. It is sufficient that the housing extend slightly above the push buttons 50 and 51 so that the push buttons may be engageable by an individual to squeeze them toward one another but such that the buttons cannot be engaged by objects sliding across the surface of the housing.

With respect to drawing FIGS. 3 and 7–13, the interior of the buckle and the latch plate are generally shown with the housing 40 being removed for purposes of clarity. As previously described, the present invention is directed to a restraint system which includes oppositely biased latching mechanisms. With respect to FIG. 3, the latching mechanisms 53 and 54 are in a form of slide blocks which are mounted within a channel 55 defined between two fixed guide blocks 56 and 57. The guide blocks are fixedly secured to the frame 41 of the buckle by rivets or suitable fasteners 58 which are shown in FIG. 11 extending through the bottom 59 of the buckle frame 41.

Figure 7:
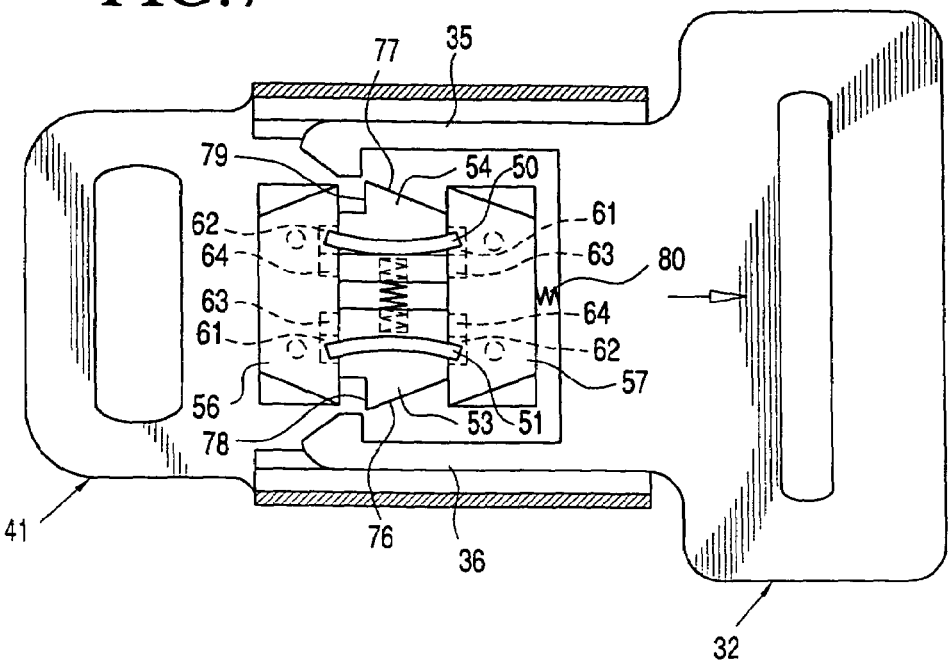
FIG. 7 is a top plan view similar to FIG. 3 except showing the oppositely biased latching mechanisms moved to a second release position to permit withdrawal of the latch plate.
Figure 8:
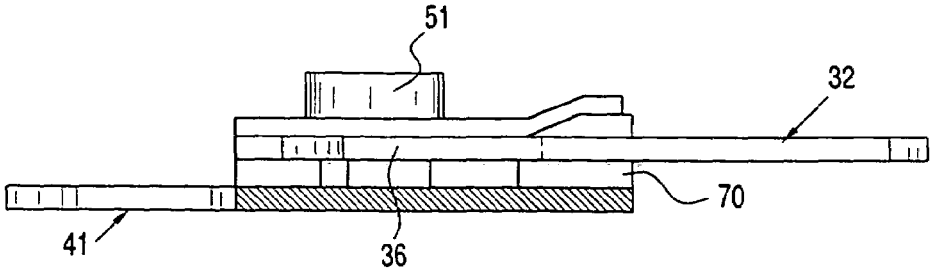
FIG. 8 is a cross-sectional view taken along line 8—8 of FIG. 3.

With specific reference to FIGS. 7, 12 and 13, the opposing inner faces of each of the guide blocks 56 and 57 includes a pair of spaced slots 61 and 62 in which are received guide members or tabs 63 and 64 which extend from opposite sides of each of the latching mechanisms 53 and 54, respectively. The guide members 63 and 64 associated with each of the latching mechanisms prevent displacement of the latching mechanisms relative to the channel 55 defined between the guide blocks 56 and 57. In FIG. 7, the positioning of the guide members within the slots 61 and 62 is shown in dotted line.

With reference to FIG. 3, each of the latching mechanisms 53 and 54 includes an opening 66 and 67, respectively, in which are seated opposite ends of a spring 68 which is mounted so as to apply a biasing force to urge the latching mechanisms in opposite directions toward sidewalls of the buckle. As shown, the spring is directly connected between the slide mechanisms such that any force which would move one latching mechanism toward the other will cause an equal and opposite force against the opposite latching mechanism.

As shown in FIG. 7, the push buttons 50 and 51 are directly mounted to the upper walls of each of the latching mechanisms such as by press fitting within openings (not shown). Each button is generally in the form of a somewhat concave lever which is of a configuration to cooperatively received the tip of an individuals finger or thumb to facilitate movement of the latching mechanisms as will be described in greater detail.

Figure 9:
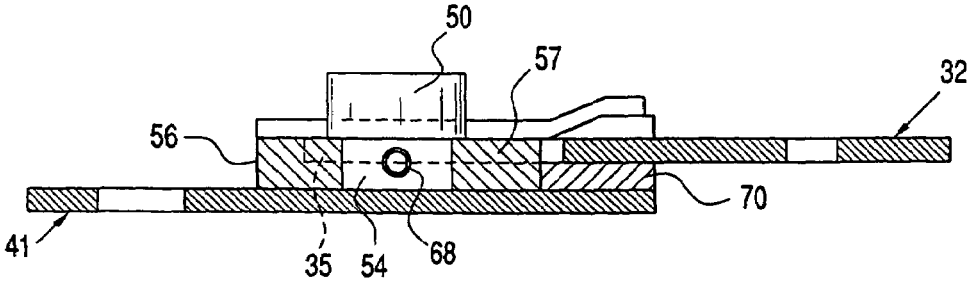
FIG. 9 is a cross-sectional view taken along line 9—9 of FIG. 3.

Also mounted within the buckle housing and to the buckle frame 41 is a guide plate 70 which is fixedly secured by appropriate fasteners, such as rivets or screws 71, see FIGS. 10 and 11. The plate generally extends about the guide blocks 56 and 57 to provide a supporting surface for the tongs 35 and 36 of the latch plate 32 as is shown in FIG. 9. Therefore, a guide channel 72 is defined between the guide plate 70 and an upper wall defined by inwardly extending flanges 73 and 74 of the frame as shown in FIGS. 12 and 13.

To engage the latch plate as it is being inserted within the housing of the buckle as shown in FIG. 3, each locking mechanism 53 and 54 includes a tapered outer wall as shown at 76 and 77 which cooperates with the end portions of the tongs 35 and 36 of the latch plate to thereby push the latch mechanisms inwardly to permit passage of the hooked ends of the latch tongs. The beveled outer edges of each of the latching mechanisms also terminate in lock dogs 78 and 79, see FIG. 10, which engage with the hooked ends 37 and 38 of the latch plate when the latch plate is fully seated within the buckle housing. At this point, the spring 68 will automatically urge the latch mechanisms 53 and 54 into their first locked position as shown in FIG. 3 of the drawings.

To release the latch plate from the buckle of the present embodiment, equal and opposite forces must be applied to the push buttons 50 and 51 to urge them together against the force of the spring 68. When pressure is applied equally to the push buttons, the latching mechanisms 53 and 54 are moved inwardly to their second or release positions which are shown in FIG. 7 of the drawings, at which time the latch tongs are no longer restrained and the latch plate is free to be released from the buckle housing. Once the latch plate has been removed, the latching mechanisms 53 and 54 will be urged outwardly again to their first locking position.

Because of the common bias against each of the latching mechanisms 53 and 54, if a force is applied to urge one of the latching mechanisms to its second release position, an equal and opposite force will be directed against the opposing latching mechanism thereby retaining it with greater force in its first locking position. Therefore, in the event of a vehicle accident wherein inertial forces are directed to the components of the buckle, at least one of the latching mechanisms will retain its engagement with the corresponding tong of the latch plate until the latching mechanisms are intentionally moved together by manual force. Thus, the restraint system is such that it will not allow a release of the latch plate by inertial forces being applied thereto which often is the case in certain vehicular accidents.

To further assist in the removal of the latch plate from the buckle housing, as shown in FIG. 7, it is possible to place a kick-out spring 80 between the guide block 57 and the body of the latch plate such that the spring automatically forces the latch plate from the buckle housing when the latching mechanisms are moved to their second release positions.

With specific reference to FIGS. 14–26 a second embodiment of the invention is disclosed in greater detail. In this embodiment, the buckle 100 is shown as having a metallic frame member 101 having an opening for receiving an anchoring belt 102. Mounted about the frame 101 is a housing 103 having an opening 104 on the front end thereof for receiving a latch plate 105. The latch plate may be similar to the one disclosed with respect to the first embodiment or may be a variation as shown at 105. In this embodiment, the latch plate includes a body portion 106 having a slot in one end for receiving a seat or harness belt 107 therethrough. The latch plate includes a pair of forwardly extending tongs 108 and 109 each of which includes a hooked end portion 110 and 111, respectively. As shown, the tongs are spaced from one another and an intermediate tang member 114 extends therebetween but terminates short of the end portions thereof.

With specific reference to FIGS. 16–22, the buckle frame 101 includes a pair of generally u-shaped sidewall channel portions 115 and 116 which define a slide channel 118 in which the latch plate 105 is slideably received. In FIGS. 16 and 20–26, the buckle housing 103 has been removed for purposes of clarity.

As with the previous embodiment, the latching mechanisms of the buckle of this embodiment are also designed to prevent release of the latch plate brought about by inertial forces being directed against the buckle. In this respect, the present invention also includes a pair of oppositely biased latching mechanisms 120 and 121 which are interconnected by a spring or other resilient element 124 which is mounted within openings 125 and 126 in the latch mechanisms. The latch mechanisms slide within a channel 128 defined between the fixed guide blocks 129 and 130 which are secured by screws or rivets as described with respect to the previous embodiment. Each latching mechanism includes oppositely oriented tabs 131 which are guiding received within spaced slots 133 in each guide block, See FIGS. 23 and 25. The outer ends of each of the guide blocks are tapered generally as shown at 132 in FIG. 16 for purposes of guiding a release mechanism as will be described in greater detail. The latching mechanisms and guide blocks are shown removed from the buckle in FIG. 27.

Figure 20:
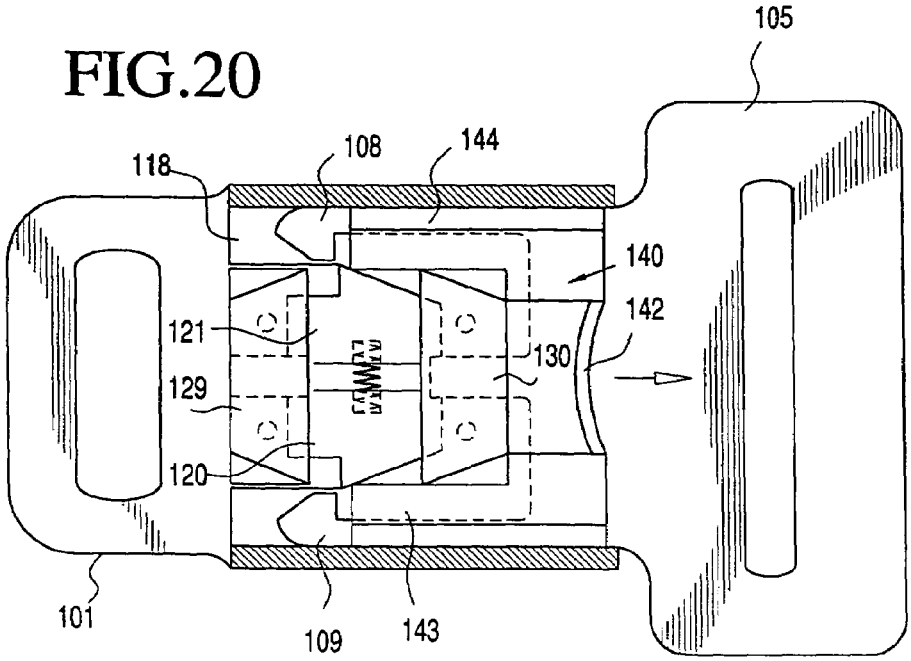
FIG. 20 is a view similar to FIG. 16 showing the latching mechanisms moved to a release position to permit removal of the latch plate of the seat belt of FIG. 14.

The outer edges of each of the latch mechanisms 120 and 121 are tapered at 135 and 136, respectively, so that the latch mechanisms may be biased by engagement with a release member, as will be described, so as to be moved from their outermost, first locking position, shown in FIG. 16, inwardly toward one another to innermost second or release positions, as shown in FIG. 20, against the force of the spring member 124. The tapered surfaces 135 and 136 terminate at edges or lock dogs 137 and 138, see FIGS. 23 and 27.

Figure 21:
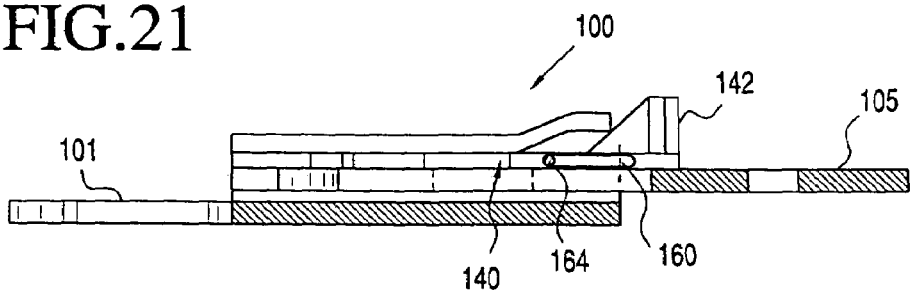
FIG. 21 is a cross-sectional view taken along line 21—21 of FIG. 16.
Figure 22:
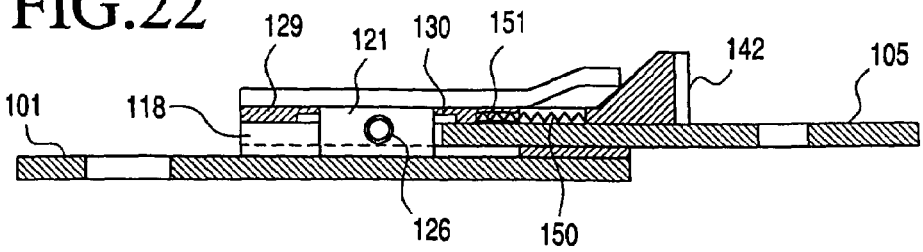
FIG. 22 is a cross-sectional view taken along line 22—22 of FIG. 16.

Although the present embodiment of the invention relies upon the same laws of physics in order to prevent non-inertial release of the latching mechanisms associated therewith, the latching mechanisms are manually controlled by a single slide element as opposed to two opposing push buttons, as previously described. In the present embodiment, a slide release member 140 is provided which is slidingly seated within the channel 118 of the buckle frame and within the channels defined by the sidewalls 115 and 116 of the frame. The slide member is preferably formed of a plastic material such as a high density polyethylene material (HDPE) and includes a body portion having an integrally formed push button 142 extending upwardly from one end thereof as shown in FIGS. 21 and 22. The opposite end of the slide member includes a pair of projections 143 and 144 each having outer ends 145 and 146, respectively. The ends 145 and 146 are designed to engage with the tapered sidewalls 135 and 136, respectively, of the latching mechanisms 120 and 121. In this manner, when the slide member is in a first position as shown in FIG. 16, the projections 143 and 144 are spaced from the latching mechanisms such that the latching mechanisms are retained in their first locking position. However, when the slide member is moved by engaging the push button 142 inwardly of the buckle housing to a position as shown in FIG. 20, the ends 145 and 146 engage the latch mechanisms and simultaneously urge them inwardly to their second or release positions to thereby release the latch plate 105 from engagement therewith. The slide release member is positioned above the latch tongs as shown in FIG. 20.

The release member 140 is normally retained in its first position by a spring element 150 having one end seated within a opening 151 in the guide block 130 and an opposite end seated within an opening (not shown) of the release slide member which is intermediate the projections 143 and 144, see FIGS. 22 and 26. Therefore, movement of the slide release member is normally resisted by the spring element 150.

Figure 16:
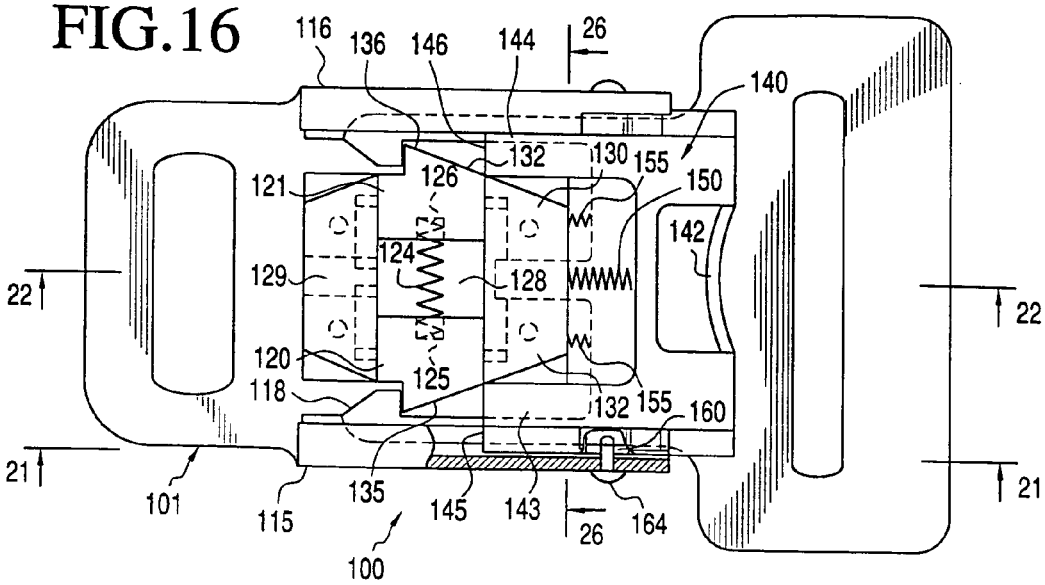
FIG. 16 is a top plan view of the buckle of FIG. 14 with the buckle housing or cover removed for clarity.

Also mounted in spaced openings 152 in the guide block 130 is a pair of kick-out springs 155 which are engageable with an edge portion of the latch plate when the latch plate is fully seated within the buckle housing as shown in FIG. 16. Upon release of the latch mechanisms by moving them to their second release position, the kick-out springs 155 will automatically push the latch plate from the buckle housing.

To positively guide the slide release plate relative to the channel members associated with the buckle frame 101, the slide member has a pair of slots 160 in each of the opposing sidewalls thereof, see FIGS. 16 and 21. Guide rivets or other elements 164 extend through the frame and serve as guide pins which ride in the slots 160 thereby preventing displacement of the slide member relative to the frame during its reciprocating motion relative thereto.

As previously described, the present embodiment may be used with a latch plate similar to the one disclosed with respect to the first embodiment. However, due to the single release slide plate 140 associated with this embodiment, the latch plate may be modified as previously described to include a central tang 114. The tang 114 is designed to extend slightly into a channel 170 which is provided completely through the guide block 130 so that the channel communicates with the channel 128 in which the latching mechanisms 120 and 121 are slidably disposed. In the event any inertial force is applied against the buckle assembly which would tend to drive the release slide plate 140 to a position to move the latching mechanisms to their second release position, the same force would be concurrently applied to the latch plate forcing it inwardly of the buckle housing such that the tang 114 passes through the channel 170 and intermediate the latching mechanisms 120 and 121, thereby effectively blocking the latching mechanisms from moving inwardly to their second release position, see FIG. 24.

As the mass of the latch plate is greater than that of the slide release member, it will move to the blocking position of FIG. 24 more quickly than the slide release 140 can move to unlock the latching mechanisms. To allow for this relative movement, the locking tongs 108 and 109 are slightly longer in length than those of the latch plate disclosed with respect to the first embodiment to permit the relative movement of the components within the buckle housing. When an inertial force is removed, the kick-out springs 155 will immediately drive the release slide member or plate to its normal position and the hooks of the latch plate tongs will again engage the lock dogs associated with the locking mechanisms.

As shown in FIGS. 18, 19, 23, 25 and 26 the latch plate normally slides over a spacer plate 172 which is fixedly secured to bottom wall 174 of the buckle frame 101. The slide release plate 140 is designed to slide relatively above the latch plate within the opposing side channels 115 and 116 of the side walls of the buckle frame.

Figure 17:
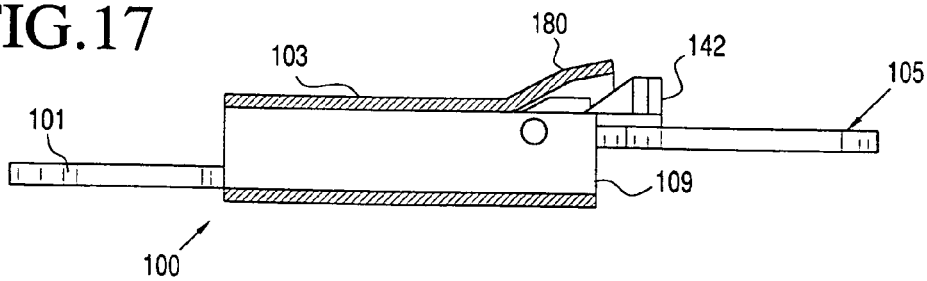
FIG. 17 is a right side view of the embodiment of FIG. 14.
Figure 18:
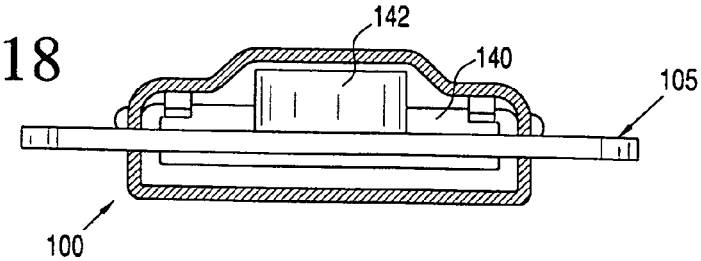
FIG. 18 is a front elevational view of the embodiment of FIG. 14.
Figure 19:
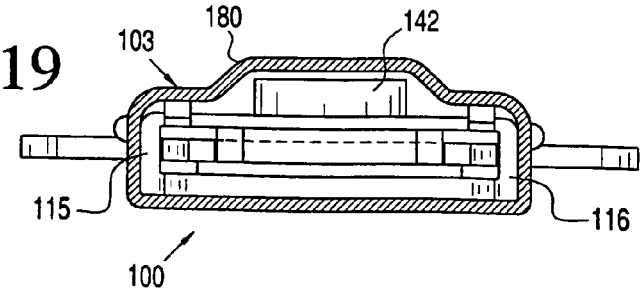
FIG. 19 is a rear elevational view of the embodiment of FIG. 14.

With specific reference to FIG. 17, the outer housing 103 of the buckle 100 includes a flared or domed section 180 adjacent the opening 104 in which the latch plate is received. The dome section 180 extends slightly above the raised push button portion 142 of the release slide plate 140 to provide clearance for the push button as it is moved from its outer position to an innermost releasing position. The dome section also provides protection for the push button and prevents inadvertent or accidental actuation of the push button.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A non-inertial release restraint buckle assembly for a vehicle having a restraining belt, the buckle assembly comprising; a buckle including a frame and a housing at least partially covering said frame, said housing having a front and rear ends and opposite sides, a latch plate receiving channel defined within said housing, an opening in said front end of said housing communicating with said latch plate receiving channel and of a size to receive a latch plate therein, a latch plate having a pair of spaced locking tongs including hooked end portions, a pair of latching mechanisms slidable mounted within said housing so as to be reciprocally movable in a guide channel defined within said housing and which extends transversely to a central longitudinal axis of said housing which extends from said front to said rear ends, biasing means disposed between said pair of latching mechanisms for urging said latching mechanisms in opposite directions toward first outer locking positions wherein said latching mechanisms are engageable with said locking tongs of said latch plate when said latch plate is inserted in said housing, release means engageable with said latching mechanisms for moving said latching mechanisms simultaneously inwardly towards said central axis of said housing to second release positions wherein said latching mechanisms are disengaged from said locking tongs of said latch plate so that said latch plate may be removed from said buckle housing, and said biasing means constantly urging said latching mechanisms toward said first locking positions with oppositely directed forces such that when one of said latching mechanisms is urged toward said second release position by a force, a simultaneous and substantially equal increase in force is applied by said biasing means to retain the other latching mechanism in said first locking position thereof such that said latching mechanisms are only releaseable upon simultaneous application of forces to move said latching mechanisms from said first locking positions to said second release positions, said release means for simultaneously sliding said latching mechanisms to said second release position including a slide release member having a pair of spaced projections extending into said housing so as to be selectively engageable with said latching mechanisms, said slide release member including a push button portion selectively manually engageable to urge said slide release member longitudinally within said housing from a first position to a second position in which said spaced projections urge said latching mechanisms simultaneously to said second release positions thereof, and means for preventing said spaced projections from moving said latching mechanisms to second release positions thereof if an inertial force is applied to urge said slide release mechanism to said second position thereof.

2. The non-inertial release restraint buckle assembly of claim 1 wherein each of said latching mechanisms includes a slide block including an outer tapered face which is engageable by one of said locking tongs when said latching mechanism is in said first locking position, said tapered face terminating at a lock dog for engaging said hooked end portion of one of said locking tongs of said latch plate.

3. The non-inertial release restraint buckle assembly of claim 2 including a pair of spaced guide blocks mounted in said housing and defining said guide channel therebetween, and each of said slide blocks including means for engaging said guide blocks to prevent said slide blocks from being disengaged from within said guide channel.

4. The non-inertial release restraint buckle assembly of claim 3 wherein said buckle frame includes a pair of opposing sidewalls defining opposing channels for receiving said locking tongs therein when said latch plate is inserted within said opening in said housing.

5. The non-inertial release restraint buckle assembly of claim 1 in which said housing includes a domed portion adjacent said front end thereof for selectively receiving said push button when said push button is urged to move said slide release member to said second position.

6. The non-inertial release restraint buckle assembly of claim 1 wherein said means for preventing said spaced projections from moving said latching mechanisms to said second release positions thereof if an inertial force is applied to urge said slide release mechanism to said second position thereof includes said latch plate having an intermediate tang disposed between said locking tongs, said tang being normally spaced in non-engaging relationship from said latching mechanisms when said latching mechanisms are in said first outer locking positions thereof wherein said latching mechanisms engage said locking tongs of said latch plate but being moveable intermediate said latching mechanisms to prevent said latching mechanisms from moving to said second release positions thereof if an inertial force is applied to said slide release member and said latching plate to drive them inwardly of said housing.

7. The non-inertial release restraint buckle assembly of claim 6 in which said buckle frame includes a pair of opposing side walls defining opposing guide channels for said slide release member, and means for retaining said slide release member in sliding relationship within said opposing guide channels.

8. The non-inertial release restraint buckle assembly of claim 6 wherein each of said latching mechanisms includes a slide block including an outer tapered face which is engageable by one of said locking tongs when said latching mechanism is in said first locking position, said tapered face terminating at a lock dog for engaging said hooked end portion of one of said locking tongs of said latch plate.

9. The non-inertial release restraint buckle assembly of claim 8 including a pair of spaced guide members mounted in said housing and defining said guide channel therebetween, and each of said slide blocks including means for engaging said guide members to prevent said slide blocks from being disengaged from within said guide channel.

10. The non-inertial release restraint buckle assembly of claim 9 wherein one of said guide members has a slot defined therein for selectively receiving said intermediate tang when said latch plate is inserted within said housing, said slot in said one of said guide members being positioned such that said tang is moveable intermediate said latching mechanisms to prevent said latching mechanisms from moving to said second release positions if an inertial force is applied to said slide release member and said latch plate to drive them inwardly of said housing.

11. The non-inertial release restraint buckle assembly of claim 6 including a first resilient means mounted within said housing for normally urging said slide release member to its first position.

12. The non-inertial release restraint buckle assembly of claim 11 including second resilient means for urging said latch plate from said buckle housing when said latching mechanisms are moved to said second release positions.

13. A method of operating a safety non-inertial safety restraint system for vehicles which system includes a latch plate having a pair of spaced locking tongs, a buckle including a housing for selectively receiving the latch plate and a pair of oppositely oriented and reciprocating latching mechanisms movable within the housing from first locking positions engaging the locking tongs of the latch plate to retain the latch plate within the housing to second positions to permit insertion and removal of the latch plate relative to the housing, and wherein a slide release member is provided for simultaneously moving the latching mechanisms to the second release positions, the method including;

a) normally retaining the slide release member in spaced non-contacting relationship from the pair of latching mechanisms and continuously urging the pair of latching mechanisms toward the first locking position thereof by generally equal and opposite resilient force, such that application of an inertial force to the buckle which causes one of the pair of latching mechanisms to be urged to the second release position thereof results in an equal and opposite force being applied to retain the other of the pair of latching mechanisms in the first locking position thereof thereby preventing accidental release of the latch plate from the buckle housing, b) moving the pair of latching mechanisms from the first locking positions thereof to the second release positions thereof as the latch plate is being inserted within the housing and such that when the latch plate is fully inserted within the housing the pair of latching mechanisms are moved to the first locking positions thereof to prevent withdrawal of the latch plate from the buckle housing, c) releasing the latch plate from the pair of latching mechanisms only upon an application of manual force by manually urging the slide release member inwardly of the housing to simultaneously urge the latching mechanisms to thereby move them to the second release positions thereof, and d) mechanically blocking the pair of latching mechanisms from moving to the second release positions thereof in the event an inertial force is applied to urge the at least one slide release member toward the pair of latching mechanisms when the latching mechanisms are in their first locking positions to thereby prevent accidental release of the latch plate.

14. The method of claim 13 including normally retaining the slide release member in spaced non-contacting relationship from the pair of latching mechanisms.

* * * * *